US010292886B2

(12) United States Patent
Wilden et al.

(10) Patent No.: US 10,292,886 B2
(45) Date of Patent: May 21, 2019

(54) THERMOTHERAPY DEVICE FOR NEWBORN AND PREMATURE INFANTS

(71) Applicant: Drägerwerk AG & Co. KGaA, Lübeck (DE)

(72) Inventors: Anja Wilden, Senden (DE); Philip Möhring, Lübeck (DE); Andreas Nandzik, Hamburg (DE); Markus Hampe, Lübeck (DE)

(73) Assignee: DRÄGERWERK AG & CO. KGaA, Lübeck (DE)

( * ) Notice: Subject to any disclaimer, the term of this patent is extended or adjusted under 35 U.S.C. 154(b) by 382 days.

(21) Appl. No.: 15/035,631

(22) PCT Filed: Nov. 10, 2014

(86) PCT No.: PCT/EP2014/003002

§ 371 (c)(1),
(2) Date: May 10, 2016

(87) PCT Pub. No.: WO2015/070969

PCT Pub. Date: May 21, 2015

(65) Prior Publication Data

US 2016/0270993 A1 Sep. 22, 2016

(30) Foreign Application Priority Data

Nov. 13, 2013 (DE) ..... 10 2013 018 919

(51) Int. Cl.
*A61G 11/00* (2006.01)

(52) U.S. Cl.
CPC ..... *A61G 11/00* (2013.01); *A61G 11/002* (2013.01); *A61G 11/006* (2013.01);
(Continued)

(58) Field of Classification Search
CPC ... A61G 11/00–11/009; A61G 2200/14; A61G 2200/32; A61G 2210/90
See application file for complete search history.

(56) References Cited

U.S. PATENT DOCUMENTS 3,326,203 A 6/1967 Goertzel
2007/0251007 A1* 11/2007 Simmerer ..... A61G 1/01 5/601

(Continued)

FOREIGN PATENT DOCUMENTS

DE 43 16 173 A1 11/1994
DE 198 55 262 A1 7/1999

(Continued)

*Primary Examiner* — Thaddeus B Cox
(74) *Attorney, Agent, or Firm* — McGlew and Tuttle, P.C.

(57) ABSTRACT

A thermotherapy device (10), for new-born and premature babies, has a bed substructure (30) and an incubator chamber (20) with a positioning aid (50) in the incubator chamber (20). The positioning aid (50) is a flexible sheet fixed to a holding structure (60). The positioning aid (50) can be stretched out by the holding structure (60). The width to which the positioning aid (50) can be stretched out is adjustable by adjusting a width of the holding structure (60). The positioning aid (50) can be pulled and/or pivoted out of the incubator chamber (20) with the aid of the holding structure (60). The holding structure (60) is movably mounted in the bed substructure. The holding structure (60) has at least two pivotable holding arms (61). The two holding arms (61) form a holding arm pair.

16 Claims, 4 Drawing Sheets

(52) U.S. Cl.
CPC ..... *A61G 2200/14* (2013.01); *A61G 2200/32* (2013.01); *A61G 2210/90* (2013.01)

(56) References Cited

U.S. PATENT DOCUMENTS

| | | | | |
|---|---|---|---|---|
| 2010/0249493 | A1 | 9/2010 | Chilton, III | |
| 2013/0025062 | A1* | 1/2013 | Esch ..... | A47D 13/02 5/655 |
| 2013/0096365 | A1 | 4/2013 | Andersson | |

FOREIGN PATENT DOCUMENTS

| | | | |
|---|---|---|---|
| DE | 200 06 758 | U1 | 9/2000 |
| DE | 200 06 785 | U1 | 8/2001 |
| DE | 20 2009 009 794 | U1 | 1/2010 |
| JP | 2011-502726 | A | 1/2011 |
| JP | 2013-529538 | A | 7/2013 |
| NL | 9 100 645 | A | 11/1992 |

* cited by examiner

THERMOTHERAPY DEVICE FOR NEWBORN AND PREMATURE INFANTS

CROSS REFERENCE TO RELATED APPLICATIONS

This application is a United States National Phase Application of International Application PCT/EP2014/003002 filed Nov. 10, 2014 and claims the benefit of priority under 35 U.S.C. § 119 of German Patent Application 10 2013 018 919.5 filed Nov. 13, 2013 the entire contents of which are incorporated herein by reference.

FIELD OF THE INVENTION

The present invention pertains to a thermotherapy device for newborn and premature infants wherein the thermotherapy device comprises a bed substructure and an incubator chamber with a supporting aid in the incubator chamber, wherein the supporting aid is a flexible cloth, which is fastened to a holding structure

BACKGROUND OF THE INVENTION

Thermotherapy devices for newborn and premature infants (infants) are generally known. There are both thermotherapy devices for open care and so-called incubators, in which the newborn and premature infants are located in a closed incubator chamber.

It was found in care practice that premature infants often require a limitation from all sides, similarly to the situation in the womb. However, this is opposed in conventional incubators by the fact that the infant lies on a flat bed surface with transparent lateral limitations.

Therefore, DE 20 2009 009 794 U1 provides for a receiving device for premature infants, which can be hung freely swinging in an incubator. The lying surface is formed here by a hammock. The hammock is hung into the incubator chamber from the top.

DE 200 06 785 U1 and DE 43 16 173 A1 also provide for a support in a supporting aid hung in the incubator chamber. DE 200 06 758 U1 describes that the hammock-like supporting aid is fastened to hooks, which are permanently anchored in the side walls of the incubator chamber. DE 43 16 173 A1 makes provisions for the infant to be firmly wrapped around by the supporting aid. The supporting aid being proposed is suspended in a rail at the top part of the incubator by means of hooks.

Just as in conventional incubators, which have no hanging supporting aid, the infants lie in all these incubators at least relatively isolated from the surrounding area in closed, transparent boxes. However, this makes it difficult to have an intimate physical connection with the parents or also with nursing staff, which is actually especially important at this stage of development.

The kangaroo method, in which the infants are temporarily removed from the incubator and brought into contact with the mother or the father skin to skin, is therefore used to various degrees in many hospitals to solve this problem. This is, however, associated with a change in the infant's position and with a more or less great distance from the incubator. This method can therefore be employed only in case of infants whose clinical status allows their removal from the incubator to a great enough distance to make such contact possible. Cables of sensors, tubes of ventilators and the like may, in particular, be a hindrance in this connection or may make it entirely impossible to remove the infant.

SUMMARY OF THE INVENTION

Based on this, an object of the present invention is to overcome these and other drawbacks of the state of the art and to provide an improved thermotherapy device for newborn and premature infants. In particular, a thermotherapy device shall be provided, which makes possible not only an optimal support, but also a temporary close physical contact between parents or nursing staff and the newborn and premature infant. Furthermore, the thermotherapy device shall be able to be manufactured as cost-effectively and simply as possible.

According to the invention, a thermotherapy device for newborn and premature infants is provided wherein the thermotherapy device has a bed substructure and an incubator chamber, wherein a supporting aid is provided in the incubator chamber and wherein the supporting aid is a flexible cloth (flexible sheet), which is fastened to a holding structure. The supporting aid is able to be stretched by the holding structure, wherein an extent to which the supporting aid is stretched can be set by the holding structure, and for the supporting aid to be able to be pulled out of the incubator chamber by means of the holding structure.

The bed substructure represents the part of the thermotherapy device on which the incubator chamber is mounted. The entire technique or a part of the technique, which is necessary for the operation of the thermotherapy device, may be arranged in the bed substructure. For example, a heater, devices for controlling the air humidity and devices for controlling the ambient atmosphere, which prevails in the incubator chamber, may be arranged in the bed substructure. It is also conceivable that devices for weighing or for X-raying the infant located in the incubator chamber are present in the bed substructure. The incubator chamber is defined in this connection as the space in which the newborn and premature infant to be cared for is located. The incubator chamber is typically defined by a reclining surface, on which the newborn and premature infant can lie, as well as by at least partly transparent side walls and a typically transparent ceiling. The reclining surface may form the boundary between the incubator chamber and the bed substructure. It is also conceivable that the reclining surface is part of the bed substructure. The incubator chamber is defined in this case by the above-mentioned side walls, the above-mentioned ceiling and the bed substructure. A mattress may optionally be arranged in the incubator chamber on the reclining surface in addition to the supporting aid located in the incubator chamber.

The supporting aid, designed as a flexible cloth, may be tensioned (stretched) to different extents as needed. A special advantage of the present invention is that the extent to which the supporting aid is stretched can be set by the holding structure. If the supporting aid is tensioned too weakly or is not tensioned (stretched), it acts like a hammock, which is hung in the incubator chamber. If, by contrast, the supporting aid is tensioned too strongly, it acts as a mattress.

It is especially advantageous if the holding structure is designed as a movable holding structure. Based on this mobility, the tension of the supporting aid can be regulated (regulatable tension), on the one hand. In other words, the holding structure may be movable such that the supporting aid can be stretched by a motion of the holding structure.

On the other hand, it is advantageous if the position of the supporting aid can be changed relative to the incubator chamber. This is favorable for this if the holding structure is mounted movably. In particular, the holding structure may be movable in such a way that the supporting aid is movable relative to the incubator chamber. For example, the supporting aid may be able to be moved out of the incubator chamber or into the incubator chamber by the movably mounted holding structure being moved correspondingly. It is also conceivable in this connection that the height of the supporting aid in the incubator chamber can be regulated by the mobility of the holding structure. In other words, one advantage of the present invention is that the holding structure is mounted movably in such as way that both the tension of the supporting aid and the position of the supporting aid relative to the incubator chamber can be regulated by a motion of the holding structure. It is not necessary at all for the motion, which regulates the tension of the supporting aid, to affect at the same time the position of the supporting aid or vice versa. It is seen that it is favorable if the holding structure can be moved and/or pivoted out of the incubator chamber. The reverse motion, by which the supporting aid can be moved into the incubator chamber, is, of course, possible as well.

Provisions may be made in this connection for the holding structure to be mounted movably in the bed substructure. This has the advantage, on the one hand, that the center of gravity of the holding structure is located relatively deep, which may have an advantageous effect on the stability of the holding structure during motion. On the other hand, the handling of the holding structure is possible in a simple manner even if the person who is, for example, pulling the holding structure out of the incubator chamber, is seated in front of the thermotherapy device and thus assumes a relatively low position in relation to the incubator chamber. In addition, it can be avoided in this manner that parts of the holding structure obstruct the view into the incubator chamber and hence to the infant located in the thermotherapy device.

It is preferred, in any case, if the holding structure has at least two pivotable holding arms. Pivoting of these holding arms and, therefore, consequently a motion of the holding structure, can then lead to a regulation of the tension of the supporting aid. The holding structure preferably has four pivotable holding arms. It is conceivable that the holding arms are circular arc-shaped. For example, the holding arms may have the shape of semicircular or quadrant-shaped rods. Other circle segments are, of course, also conceivable. Each of these rods has a first end and a second end each. It is conceivable in this connection that at least one end of the respective holding arm protrudes, for example, as a free end, into the incubator chamber. The holding arms may be mounted in the holding structure such that they can move, following their shape, on circular arc-shaped paths. For example, each holding arm may be able to be displaced along a circular arc-shaped path, the radius of the circular arc-shaped path corresponding to the radius of the circular arc of the holding arm. The holding arms are preferably oriented in relation to one another in the holding structure such that their end points can move towards one another or away from one another during a motion along these circular arc-shaped paths.

It is seen that it is favorable if two holding arms each form a pair of holding arms. It is conceivable in this connection that the holding arms of a pair of holding arms are mounted movably in such a way that they can mutually slide past each other. Each holding arm may have an outer end point and an inner end point. The inner end point is the end point facing the respective other holding arm. The outer end point is the free end, which protrudes into the incubator chamber. By pivoting the holding arms of one pair of holding arms, the distance between the outer end points of a pair of holding arms can then be increased or decreased. The motion of the end points preferably also follows the circular arc-shaped path predefined by the shape of the holding arms.

At least one fastening point is preferably formed for the supporting aid on each holding arm in such a holding structure. The fastening point is preferably formed especially preferably at a respective end point, and especially preferably at the outer end point, of the holding arm. It is also conceivable in this connection that the fastening point is formed by a hook, into which the supporting aid can be hung. The hook may be, for example, a lockable safety hook. As an alternative, other fastening mechanisms, such as snapping in, screwing or other methods, are, of course, also conceivable. The only thing that is essential in this connection is that the supporting aid be able to be fastened at the fastening points. The supporting aid can preferably be fastened reversibly at the fastening points. This facilitates the replacement of the supporting aid and the cleaning of the thermotherapy device. It is conceivable, for example, that the supporting aid, which is in the form of a cloth, as was described above, has a rectangular shape, and each corner of the cloth is fastened at a fastening point of the holding structure.

The position of the fastening point changes within the incubator chamber due to the pivoting of the holding arms. It is favorable in this connection if the height of the fastening points of the supporting aid are adjustable independently from one another. The supporting aid preferably has a foot end and a head end. This also applies to the thermotherapy device and the incubator chamber. For example, the fastening points at which the foot end of the cloth is fastened may be located in this case at a different height than the fastening points at which the head end of the cloth is fastened. An oblique position of the supporting aid can be obtained in this manner. An oblique position is a position in which the infant lying in the supporting aid is not lying parallel to the mattress. It is seen that it is especially advantageous if the height of the fastening points of the supporting aid is adjustable in pairs. The adjustment of the height is performed according to the present invention by pivoting the holding arms along the circular arc-shaped paths already described above.

It is seen, furthermore, that it is favorable if the holding structure has two pairs of holding arms. One pair may be arranged in the area of the head end of the incubator chamber and the other pair in the area of the foot end of the incubator chamber. The head end of the supporting aid may correspondingly be able to be fastened at the holding arm of the pair arranged in the area of the head end, while the foot end of the supporting aid may be able to be fastened at the holding arm of the pair arranged in the area of the foot end. The first pair of the holding arms stretches the head end of the supporting aid here, while the second pair of the holding arms stretches the foot end of the supporting aid.

It is also preferred if the holding structure has at least one mounting box for the holding arms. It is conceivable, for example, that the holding arms can be retracted in the mounting box. It is thus conceivable, for example, that the holding arms are mounted movably in the mounting box, and the outer ends of the holding arms can be extended from the mounting box. Guide rollers, which hold the holding arms in the correct position during the pivoting, may be present in the mounting box.

If the holding arms are fully retracted in the mounting box, the supporting aid is preferably located flat, spread out on the supporting aid in the incubator chamber, for example, on the mattress. The infant lying in the supporting aid can be laid down gently on the reclining surface in this manner. As an alternative, the supporting aid may also be removed before the holding arms have been completely retracted. This is favorable, for example, if it is desirable for the infant to lie directly on the mattress.

It is also conceivable that the holding structure has two mounting boxes. Especially if the holding structure has two pairs of holding arms, each of these pairs may be mounted in a mounting box. It is thus conceivable, for example, that a first mounting box is arranged at the head end of the thermotherapy device and that a second mounting box is arranged at the foot end of the thermotherapy device. The head end of the thermotherapy device corresponds here to the head end of the incubator chamber and the foot end of the thermotherapy device corresponds to the foot end of the incubator chamber.

It is especially favorable if the mounting box or the mounting boxes can be pulled out of the thermotherapy device. The entire holding structure can be pulled out of the thermotherapy device in this manner. The supporting aid is thus also pulled out of the thermotherapy device, especially from the incubator chamber, with the holding structure. It is preferred in this connection if the holding structure can be pulled out laterally. It is thus conceivable that the bed substructure has a table-like design, in which case the reclining surface may correspond to the "table surface," and the "table surface" is covered by the incubator chamber—covered by side walls and an upper wall. The holding structure comprises, for example, two pairs of holding arms, wherein each pair is mounted in a mounting box. The holding arms can be retracted in the respective mounting box. A fastening point is formed for the cloth-like supporting aid at the outer end of each holding arm. A corner of the preferably rectangular supporting aid is fastened at each of these fastening points. One of the two mounting boxes is arranged in the area of the foot end of the incubator chamber. The other mounting box is arranged in the area of the head end of the incubator chamber. It is especially favorable in this connection if the mounting boxes are arranged in the bed substructure such that their upper surface ends flush with the lower surface of the incubator chamber, for example, with the reclining surface on which, for example, the mattress may lie. It is also conceivable that one mounting box or all of the mounting boxes has/have grips, by means of which the mounting boxes and therefore the holding structure can be pulled out of the incubator chamber or the thermotherapy device.

It is advantageous if the mounting boxes are guided telescopically in the bed substructure. The holding structure can thus be pulled out of and pushed into the thermotherapy device rapidly and in a simple manner. It is especially favorable in this connection if the holding structure has a sliding mechanism, so that the mounting boxes can only be moved synchronously. An unintended bracing or warping of the supporting aid during the motion of the holding structure can effectively be prevented in this manner.

It is seen that it is favorable if the bed substructure is table-like. This facilitates sitting at the incubator. It is conceivable that the bed substructure has two vertically adjustable columns. It is also conceivable, as an alternative, that the bed substructure has an eccentric, flexurally rigid column or that the bed substructure has a central lifting column.

It is also favorable if the holding structure has a drive mechanism. It is conceivable in this connection that the holding arms of a pair of holding arms can be moved synchronously with one another by means of the drive mechanism. For example, the holding arms may have circular arc-like toothed racks. It is also conceivable that the holding arms themselves are designed simply as circular arc-like toothed racks. The drive mechanism may now have a gear, which can transmit the motion of a mechanical or electric drive to the holding arms. It is conceivable, for example, that the gear is arranged between the toothed racks of the holding arms, so that the holding arms can be moved synchronously by means of the gear. It is seen that the gears may be actuated by a motor and/or manually. For example, one or more hand cranks, which drive the gears, may be present for a manual actuation.

It is also especially advantageous if the supporting aid has a heater. It is conceivable, for example, that a flat heater is integrated in the cloth-like supporting aid. The infant lying in the supporting aid can be kept warm in this manner not only within the incubator chamber, but also with the holding structure removed, outside the incubator chamber. It is also conceivable that the heater may be designed as a heating ceiling. For example, the supporting aid may be formed by a heating ceiling or the supporting aid may be a hammock, in which the heating ceiling is integrated. An electric resistance heater or even a fluid heater is also conceivable, among other things.

To make it possible to pull the holding structure and thus the supporting aid with the infant located in it out of the thermotherapy device, it is advantageous if the incubator chamber has at least one pivotable side wall. It is conceivable in this connection, for example, that the side wall is pivotable by means of a parallelogram linkage. It is especially favorable in this connection if the parallelogram linkage is arranged in an area of the incubator housing that is different from the incubator chamber. For example, the side wall may be hung on one side at the parallelogram linkage. The side wall can easily be pivoted upward or downward in this way in a simple manner.

It is seen, on the whole, that the special advantage of the solution according to the present invention is that the supporting aid has the form of a hammock, which is integrated in the thermotherapy device, and the hammock can tightly enclose the infant and can be pulled out of the thermotherapy device laterally, especially out of the incubator chamber of the thermotherapy device, together with the infant by means of the holding structure. Parents or nurses, who are sitting or standing next to the thermotherapy device, can assume a close physical contact with the infant in this manner, while the infant continues to be in his or her lying position and thus experiences as little stress as possible. The possibility of sitting by the thermotherapy device is additionally supported by the especially flat, table-like design—four leg configuration with upper surface—of the bed substructure. In addition, the special design of the holding structure makes it possible to position the infant in an oblique position, which may be desirable for certain medical purposes. This is made possible, in particular, by the fastening points, which are formed at the ends of the holding arms and which are vertically adjustable independently from one another, preferably in pairs. The supporting aid can thus also enclose the infant with varying tightness or adapt to the size of the infant's body due to this vertical adjustment. By fully retracting the holding arms in the mounting boxes of the holding structure, the infant can be placed gently on the reclining surface arranged under the supporting aid, for example, a mattress.

To keep the infant warm outside the thermotherapy device as well, a flat heater may be integrated in the hammock. Furthermore, it is advantageous that the supporting aid can be detached from the fastening points in a simple manner and that the holding arms can fully be retracted in the mounting boxes. The thermotherapy device can also be used in this manner in the conventional manner in certain cases, i.e., with a fat reclining surface and a mattress lying thereon. It is also favorable that the supporting aid can easily be removed in order to make it possible to regularly replace and clean the supporting aid.

Further features and details appear from the figures and exemplary embodiments described below. It is obvious that these exemplary embodiments are purely exemplary and that the person skilled in the art will find further variants and exemplary embodiments without problems on the basis of the above description.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
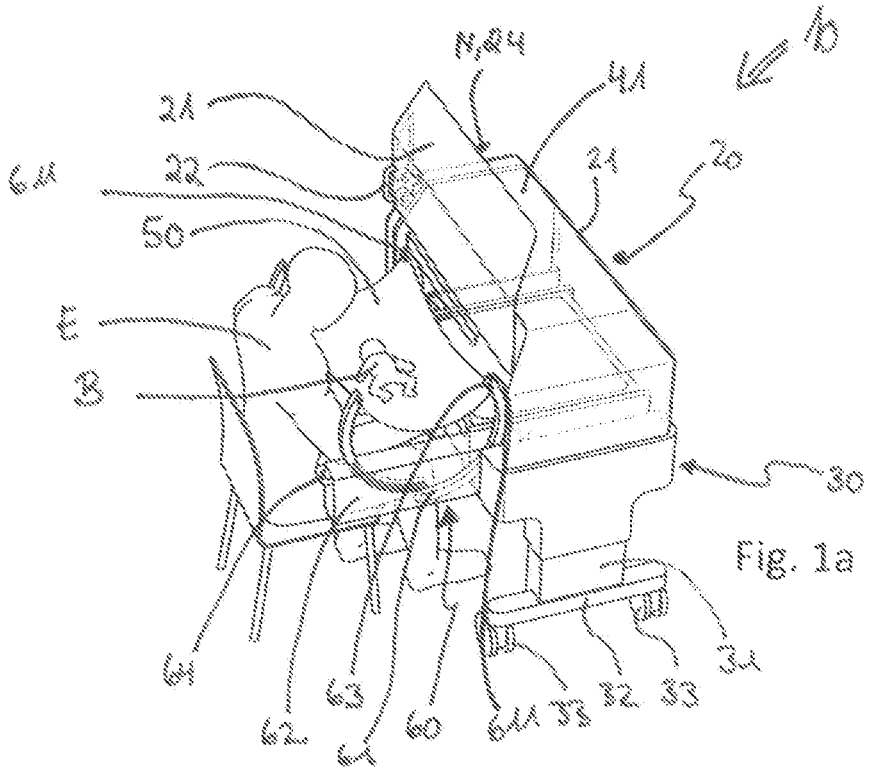
FIG. 1*a* is a perspective view showing a thermotherapy device with the holding structure according to the present invention in the state in which it is pushed out of the incubator chamber.

Identical reference numbers always designate identical components below in all figures. The thermotherapy device 10 shown in FIGS. 1*a* and 1*b* has a bed substructure 30 and an incubator cover comprising walls on the bed substructure 30 forming an incubator chamber 20. The bed substructure 30 has a first and a second support column 31. The support columns 31 are arranged each at the head end N and at the foot end S of the thermotherapy device 10. A foot bar 32 as well as rollers 33 are arranged at the support columns 31. The thermotherapy device 10 is both displaceable and is mounted in a stable manner in this way. The incubator chamber 20 is defined by a reclining surface 40, a ceiling 41 and side walls 21. The side walls 21 are pivotable in a vertical direction, so that the incubator chamber 20 can be opened. In the example being shown, the side wall 21 facing the nursing adult E is pivoted upward. A grip 22, by means of which the side wall 21 can be moved, is formed on the side wall 21. It is seen in FIG. 1*b* that a parallelogram linkage 23 is arranged at the head end 24 of the incubator chamber 20. The side wall 21 can be pivoted by means of this parallelogram linkage 23.

The thermotherapy device 10 has, furthermore, a holding structure 60 and a supporting aid 50 fastened to the holding structure 60. In the example being shown, the holding structure 60 has two mounting boxes 62, in which a pair of holding arms 61 each is arranged. The supporting aid 50 is fastened to the holding arms 61. The holding arms 61 have fastening points 63 for this at their ends 611. A grip 64 is arranged on each mounting box 62. The holding structure 60 can be pulled out of the incubator chamber 20 by means of the grips 64.

Figure 1B:
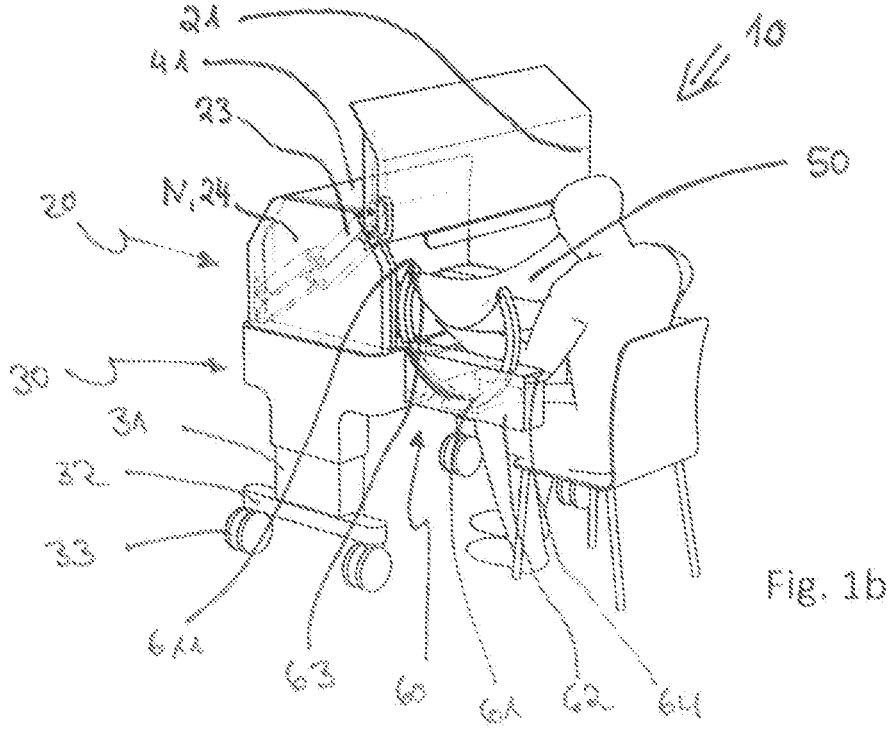
FIG. 1*b* is another perspective view showing the thermotherapy device shown in FIG. 1*a;*

In the state shown in FIGS. 1*a* and 1*b*, an infant B to be cared for is lying on the supporting aid 50. The incubator chamber 20 is opened and the supporting aid 50 has been pulled out of the incubator chamber 20 together with the infant B lying on it. An adult E is sitting, similarly to the way one sits at a table, in front of the thermotherapy device 10 and has optimal access to and contact with the infant B in this way.

Figure 2A:
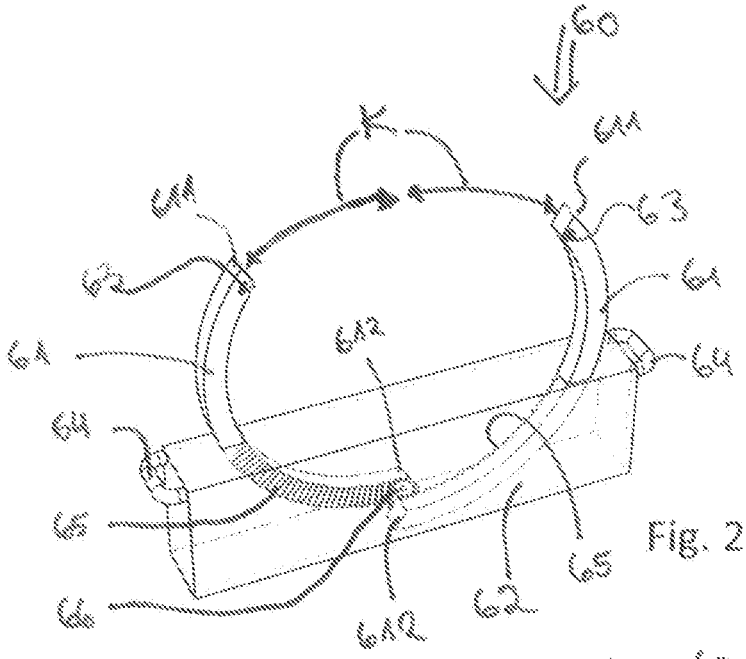
FIG. 2*a* is a perspective detail view showing the holding structure according to the present invention with holding arms fully pivoted upward.
Figure 2B:
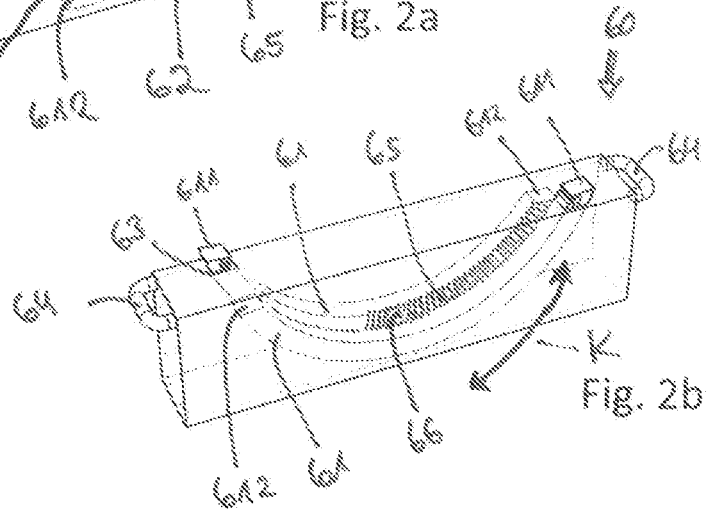
FIG. 2*b* is another perspective detail view showing the holding structure shown in FIG. 2*a* with the holding arms lowered.
Figure 2C:
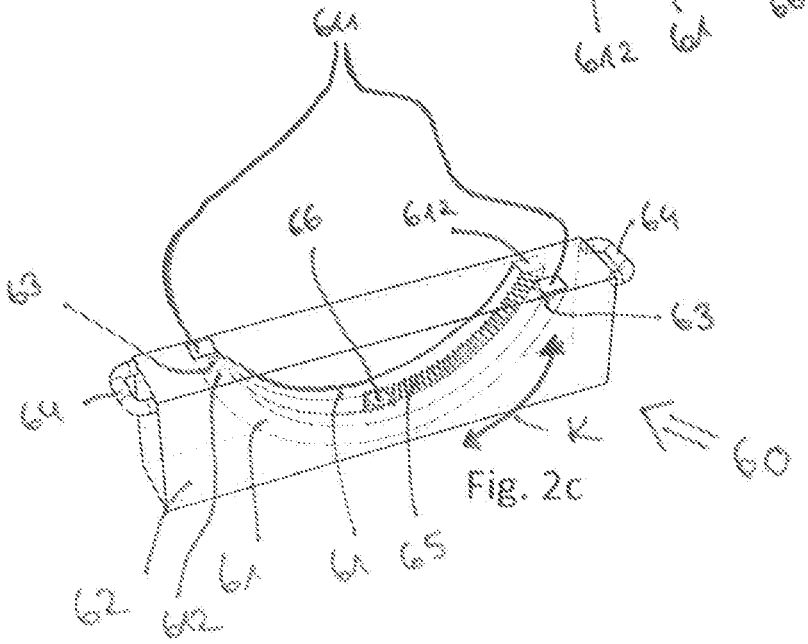
FIG. 2*c* is another perspective detail view showing the holding structure shown in FIGS. 2*a* and 2*b* with holding arms retracted in the mounting box.

FIGS. 2*a*, 2*b* and 2*c* show a detail view of a detail of the holding structure 60. Two holding arms 61 each form a pair of holding arms. The holding arms 61 are in the form of circular arc segments. Each holding arm 61 of the pair of holding arms has an outer end 611 and an inner end 612.

A fastening point 63 each is formed at the outer ends 611 of the holding arms 61. The fastening point 63 is hook-shaped in the example being shown. The supporting aid 50 can be fastened to the holding structure 60 at these fastening points 63, as can be seen in FIGS. 1*a*, 1*b*, 3*a*, 3*b*, 3*c*, 4*a*, 4*b* as well as 4*c*.

The inner end 612 of each holding arm 61 faces the other holding arm 61 of the pair of holding arms. The inner ends 612 of the holding arms 61 are located directly next to each other in the fully extended state of the pair of holding arms, as it is shown in FIG. 2*a*. It is seen that at least one section is designed as a toothed rack 65 on each holding arm 61. It is also conceivable, as an alternative, that a toothed rack 65 is mounted on each holding arm 61. A gear 66 is arranged between the holding arms 61. The gear 66 meshes with the toothed racks 65 of the holding arms 61. It is seen that the holding arms 61 can be pivoted by a rotation of the gear 66 in mutually opposite directions along the circular arc-shaped path K. The extent to which the supporting aid 50 is stretched can be set in this manner by means of the holding structure 60. It is seen, in particular, that the outer ends 611 of the holding arms 61 can be moved towards one another and away from one another by the pivoting of the holding arms 61 along the circular arc-shaped path K. At the same time, the height at which the fastening points 63 are located above the reclining surface 40 can be set in this way.

The detail of the holding structure 60 shown in FIG. 2*a* can likewise be seen in FIGS. 2*b* and 2*c*. However, the holding arms 61 are retracted far into the mounting box 62 in FIG. 2*b*. The holding arms 61 are fully retracted in the mounting box 62 in FIG. 2*c*, just like in FIG. 3*d*.

It can also be seen in FIGS. 3*a*, 3*b*, 3*c* and 3*d* that the supporting aid 50 is stretched by the holding structure 60 and that the extent to which the supporting aid 50 is stretched can be set by means of the holding structure 60. Thus, the holding arms 61 is extended to the greatest extent possible and the fastening points 63 are located in the highest position possible in FIG. 3*a*. All fastening points 63 of the holding arms 61 are positioned at the same height. The supporting aid 50 functions as a hammock, in which the infant B is lying.

Figure 3A:
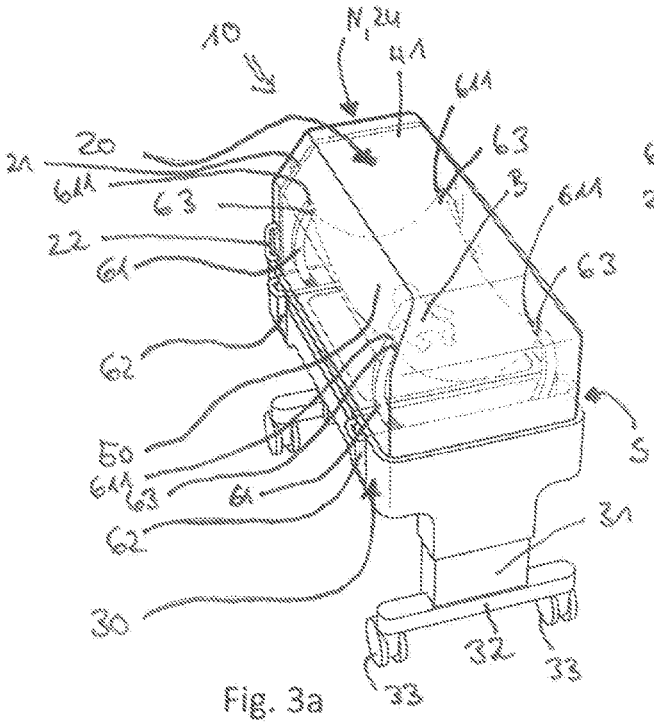
FIG. 3*a* is a perspective view showing the thermotherapy device from FIGS. 1*a* and 1*b* with the supporting aid located in the incubator chamber, wherein the supporting aid acts as a hammock.
Figure 3B:
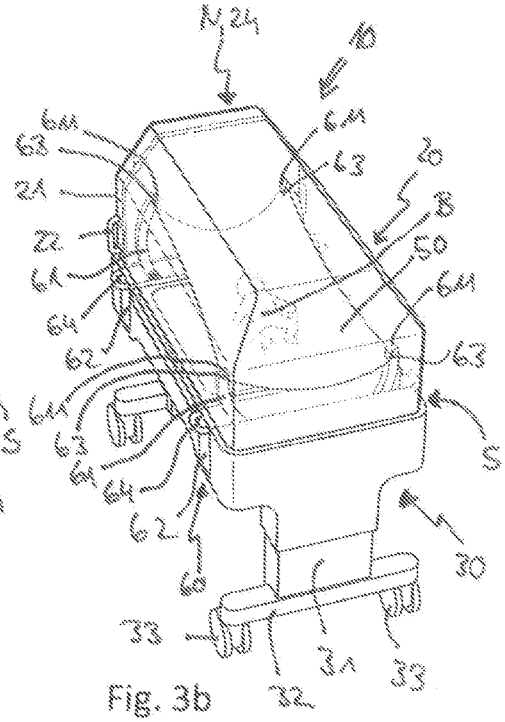
FIG. 3*b* is a perspective view showing the thermotherapy device from FIGS. 1*a* and 1*b* with the supporting aid located in the incubator chamber, wherein an obliquely positioned reclining surface is formed with the supporting aid.

It is seen in FIG. 3*b* that the supporting aid 50 is positioned obliquely in such a way that the head of the infant B is located higher than his or her feet. The opposite of this, namely, the foot being higher than the head, is, or course, also possible. It is seen that the holding arms 61 arranged at the head end N, 24, are extended farther from the corresponding mounting box 62 than the holding arms 61 arranged at the foot end S. As a consequence, the fastening points 63, which are formed at the holding arms 61 at the head end N, 24, are in a higher position than the fastening points 63, which are formed at the holding arms at the foot end S.

Figure 3C:
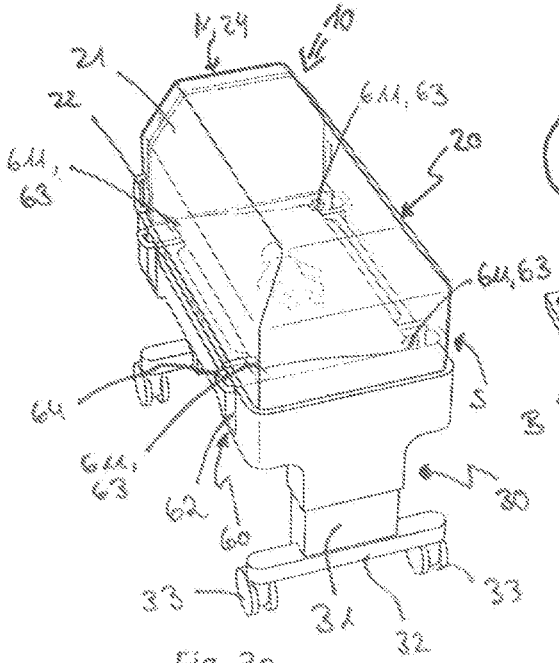
FIG. 3*c* is a perspective view showing the thermotherapy device from FIGS. 1*a* and 1*b* with the supporting aid located in the incubator chamber, wherein the supporting aid acts as a mattress.

It is seen in FIG. 3*c* that the supporting aid 50 is tensioned nearly completely. The holding arms 61 are retracted, as is shown in FIG. 2*b*, into the mounting boxes 62 to the extent that only the fastening points 63 protrude from the mounting boxes 62. The infant is lying on the supporting aid 50 as on a mattress.

Figure 3D:
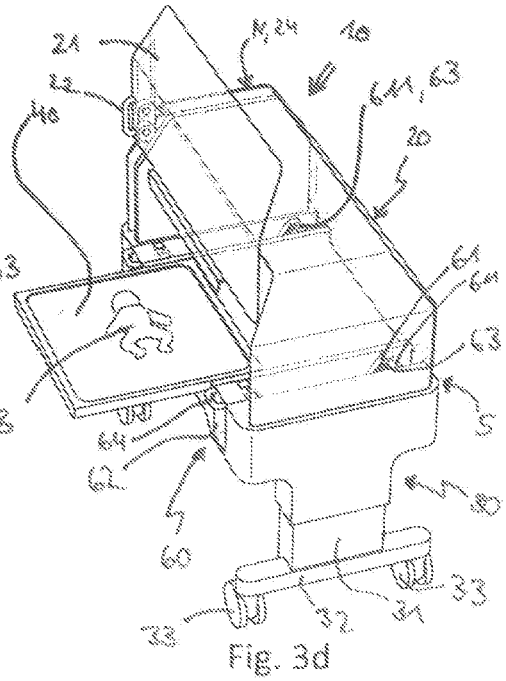
FIG. 3*d* is a perspective view showing the thermotherapy device from FIGS. 1*a* and 1*b*, wherein the supporting aid was removed and the infant is placed on an additionally present mattress, while the holding arms are retracted in the mounting boxes of the holding structure.

As is shown in FIG. 2*c*, the holding arms 61 are fully retracted into the mounting boxes 62 in FIG. 3*d*. The supporting aid 50 is removed and the infant B is lying on the reclining surface 40 of the thermotherapy device 10. The reclining surface 40 may likewise be designed as a reclining surface that can be pulled out, as it is likewise seen in FIG. 3*d*.

Figure 4A:
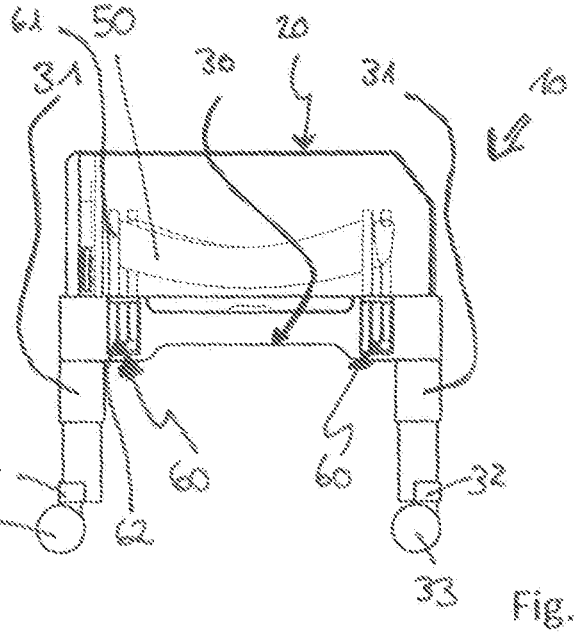
FIG. 4*a* is an end view showing a thermotherapy device according to the present invention, in which the bed substructure has a table-like (four leg and upper surface) design.
Figure 4B:
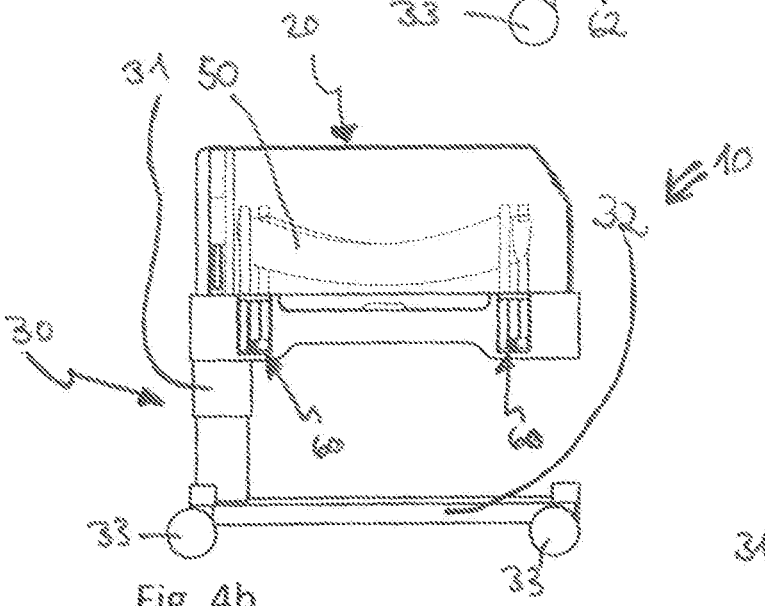
FIG. 4*b* is an end view showing a thermotherapy device according to the present invention, in which the bed substructure is formed with a lateral column.
Figure 4C:
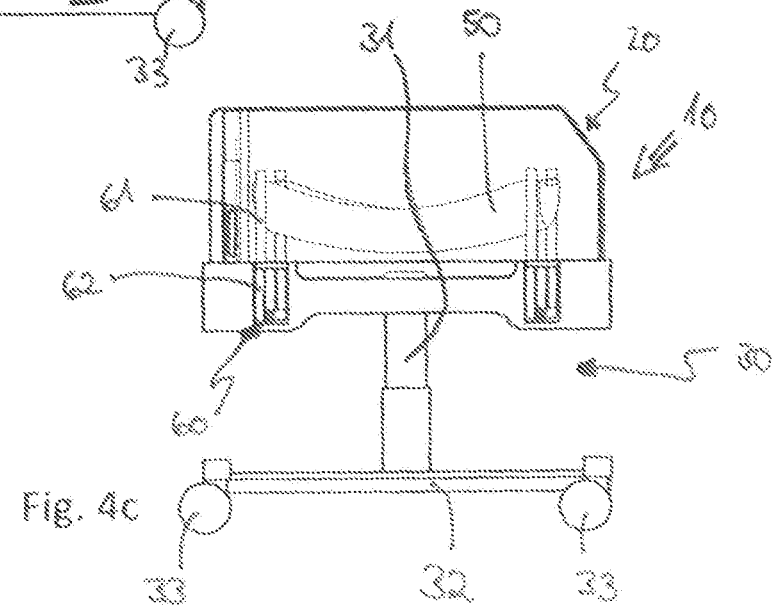
FIG. 4*c* is an end view showing a thermotherapy device according to the present invention, in which the bed substructure has a central column.

FIGS. 4*a*, 4*b* and 4*c* show as examples different variants for the bed substructure 30. The bed substructure 30 has two support columns 31 in the example shown in FIG. 4*a*, which corresponds to the example from FIGS. 1*a*, 1*b*, 3*a*, 3*b*, 3*c* and 3*d*. The support columns 31 are arranged at the head end N and at the foot end S of the thermotherapy device 10. The bed substructure 31 has a four leg table configuration—table-like—in FIG. 4*a*.

In the alternative examples shown in FIGS. 4*b* and 4*c*, the bed substructure 30 has only one support column 31, which is arranged either at the head end N of the thermotherapy device 10, as in FIG. 4*b*, or centrally under the reclining surface 40 of the thermotherapy device 10, as in FIG. 4*c*. The foot bar 32 is designed as a chassis in both cases and has a plurality of rollers 33. In addition, the foot bar 32 may form a support for the adult caring for the infant and sitting at the device in the exemplary embodiments shown in FIGS. 4*b* and 4*c*.

All the features and advantages appearing from the specification and the drawings, including design details, arrangements in space and method steps, may be essential for the present invention both in themselves and in the many different combinations.

In summary, it is seen that it is favorable in a thermotherapy device 10 for newborn and premature infants, wherein the thermotherapy device 10 has a bed substructure 30 and an incubator chamber 20, wherein a supporting aid 50 is provided in the incubator chamber 20 and wherein the supporting aid 50 is a flexible cloth, which is fastened to a holding structure 60, if the supporting aid 50 can be stretched by the holding structure 60, wherein the extent to which the supporting aid 50 is stretched can be set by the holding structure 60, and that the supporting aid 50 can be pulled out of and/or pivoted out of the incubator chamber 20 by means of the holding structure 60. It is advantageous in this connection if the holding structure 60 is mounted movably in the bed substructure 30. In addition, it is advantageous if the holding structure 60 has at least two pivotable holding arms 61, and two holding arms 61 each preferably form a pair of holding arms, and wherein the holding structure 60 especially preferably has two pairs of holding arms 61. At least one fastening point 63 is formed for the supporting aid 50 on each holding arm 6 and the holding structure 60 has at least one mounting box 62 for the holding arms 61. At least one mounting box 62 is preferably moveably guided telescopically in the bed substructure 30. On the whole, it is favorable if the bed substructure 30 is table-like, if the holding structure 60 has a drive mechanism, if the supporting aid 50 has a heater and if the incubator chamber 20 has at least one pivotable side wall 21.

While specific embodiments of the invention have been shown and described in detail to illustrate the application of the principles of the invention, it will be understood that the invention may be embodied otherwise without departing from such principles.

The invention claimed is:

1. A thermotherapy device for newborn and premature infants, the thermotherapy device comprising:

a bed substructure;

an incubator chamber;

a supporting aid in the incubator chamber, the supporting aid comprising a flexible cloth; and a holding structure with fastening points, the supporting aid being fastened to the holding structure at the fastening points, the holding structure comprising supporting aid stretch adjustment means for adjusting and holding an extent of spacing of the fastening points relative to each other, whereby the flexible cloth is adjustably stretched by the holding structure and set at a defined stretched extent, wherein an extent to which the supporting aid is stretched is set by the holding structure, and the holding structure further comprising lateral adjustment means for moving and supporting the fastening points, with the supporting aid, laterally between a position above the bed substructure, and in the incubator chamber, to a position at least partially outside of the incubator chamber and at least partially laterally offset from the position above the bed substructure, whereby the supporting aid can be pulled out or pivoted out or both pulled out and pivoted out of the incubator chamber with the holding structure.

2. A thermotherapy device in accordance with claim 1, wherein the lateral adjustment means of the holding structure comprises a moveably guided mount whereby the holding structure is mounted movably relative to the bed substructure.

3. A thermotherapy device in accordance with claim 1, wherein the stretch adjustment means of the holding structure comprises at least two pivotable holding arms.

4. A thermotherapy device in accordance with claim 3, wherein two holding arms each form a pair of holding arms.

5. A thermotherapy device in accordance with claim 4, wherein at least one of the fastening points is formed at each holding arm for the supporting aid.

6. A thermotherapy device in accordance with claim 3, wherein the stretch adjustment means of the holding structure comprises two pairs of holding arms.

7. A thermotherapy device in accordance with claim 3, wherein the holding structure has at least one mounting box for the holding arms.

8. A thermotherapy device in accordance with claim 1, wherein the bed substructure has a four leg support structure.

9. A thermotherapy device in accordance with claim 1, wherein the holding structure has a drive mechanism.

10. A thermotherapy device in accordance with claim 1, wherein the supporting aid has a heater.

11. A thermotherapy device in accordance with claim 1, wherein the incubator chamber has at least one pivotable side wall.

12. A thermotherapy device for newborn and premature infants, the thermotherapy device comprising:

a bed substructure;

an incubator chamber;

a supporting aid in the incubator chamber, the supporting aid comprising a flexible cloth; and a holding structure, the supporting aid being fastened to the holding structure with the holding structure being moveable whereby the supporting aid is stretched by the holding structure, wherein an extent to which the supporting aid is stretched is set by the holding structure, and the supporting aid can be pulled out or pivoted out or both pulled out and pivoted out of the incubator chamber with the holding structure, wherein the holding structure has at least two pivotable holding arms;

the holding structure has at least one mounting box for the holding arms; and the at least one mounting box is guided telescopically in the bed substructure.

13. A thermotherapy device for newborn and premature infants, the thermotherapy device comprising:

a bed substructure;

incubator walls connected to the bed substructure to form a chamber;

a flexible support sheet;

a holding structure with fastening points, the flexible support sheet being connected to the holding structure at the fastening points, the holding structure being moveable to adjustably move the fastening points relative to each other to stretch and unstretch the flexible support sheet and the holding structure being moveably mounted on the bed substructure whereby the holding structure, with the flexible support sheet, may be moved in and out of the incubator chamber, wherein the holding structure comprises:

a first pair of moveable holding arms having a first fastening point and a second fastening point, wherein the first fastening point and the second fastening point are moveable farther apart and closer together to respectively stretch and unstretch an end of the flexible support sheet;

a second pair of moveable holding arms having a third fastening point and a fourth fastening point, wherein the third fastening point and the fourth fastening point are moveable farther apart and closer together to respectively stretch and unstretch another end of the flexible support sheet;

a first mounting box supporting the first pair of holding arms and moveably mounted on the bed substructure to move the first pair of holding arms in and out of the incubator chamber; and a second mounting box supporting the second pair of holding arms and moveably mounted on the bed substructure to move the second pair of holding arms in and out of the incubator chamber.

14. A thermotherapy device in accordance with claim 13, wherein each of the first mounting box and the second mounting box is guided telescopically in the bed substructure.

15. A thermotherapy device in accordance with claim 14, wherein the bed substructure comprises a four leg support structure.

16. A thermotherapy device in accordance with claim 15, wherein the incubator walls forming the chamber comprise a pivotable side wall.

* * * * *